US010190448B2

(12) United States Patent
Schelter et al.

(10) Patent No.: US 10,190,448 B2
(45) Date of Patent: Jan. 29, 2019

(54) CAMSHAFT ADJUSTER

(71) Applicant: Schaeffler Technologies AG & Co. KG, Herzogenaurach (DE)

(72) Inventors: Stefan Schelter, Dottenheim (DE); Christoph Betz, Herzogenaurach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 91 days.

(21) Appl. No.: 15/129,265

(22) PCT Filed: Mar. 4, 2015

(86) PCT No.: PCT/DE2015/200117
§ 371 (c)(1),
(2) Date: Sep. 26, 2016

(87) PCT Pub. No.: WO2015/149763
PCT Pub. Date: Oct. 8, 2015

(65) Prior Publication Data

US 2017/0101904 A1 Apr. 13, 2017

(30) Foreign Application Priority Data

Apr. 4, 2014 (DE) ..... 10 2014 206 479

(51) Int. Cl.
*F01L 1/34* (2006.01)
*F01C 1/34* (2006.01)
(Continued)

(52) U.S. Cl.
CPC ..... *F01L 1/3442* (2013.01); *F01C 1/34* (2013.01); *F01C 21/08* (2013.01); *F01C 21/104* (2013.01);
(Continued)

(58) Field of Classification Search
CPC ..... F01C 1/34; F01C 21/08; F01C 21/104; F01L 1/047; F01L 1/3442;
(Continued)

(56) References Cited

U.S. PATENT DOCUMENTS 5,823,152 A 10/1998 Ushida et al.
5,832,887 A 11/1998 Adachi et al.
(Continued)

FOREIGN PATENT DOCUMENTS

DE 19742947 4/1998
DE 102012217394 3/2004
(Continued)

*Primary Examiner* — Mark Laurenzi
*Assistant Examiner* — Wesley Harris
(74) *Attorney, Agent, or Firm* — Davidson, Davidson & Kappel, LLC

(57) ABSTRACT

A hydraulic camshaft adjuster of the vane cell type, including a rotor and a stator and including a cover having fastening holes extending all the way through for accommodating fasteners. Via the fasteners the cover is fastened at an end face to the stator. The cover has a locking hole, into which a locking pin accommodated in the rotor can be displaced in an axial direction in order to lock the rotor in relation to the stator. The position of the locking pin in the rotor is pivoted about the axis of rotation by an angle in relation to a fastener when the camshaft adjuster is used as an exhaust adjuster, the position of the locking pin in the rotor is pivoted about the axis of rotation by an angle α" in relation to a fastener when the camshaft adjuster is used as an intake adjuster, and the position of the locking hole in the cover is pivoted about the axis of rotation by an angle α in relation to the position of a fastening hole, wherein the rotor and the stator are coordinated with each other in such a way that the angles α, α', and α" are equal in magnitude and the pivoting directions of the angle α' and α" are oppositely directed.

15 Claims, 4 Drawing Sheets

(51) Int. Cl.

| | |
|---|---|
| ***F01C 21/08*** | (2006.01) |
| ***F01C 21/10*** | (2006.01) |
| ***F01L 1/047*** | (2006.01) |
| ***F01L 1/344*** | (2006.01) |

(52) U.S. Cl.
CPC ..... *F01L 1/047* (2013.01); *F01L 1/344* (2013.01); *F01L 2001/34453* (2013.01); *F01L 2001/34459* (2013.01); *F01L 2001/34469* (2013.01); *F01L 2001/34479* (2013.01)

(58) Field of Classification Search
CPC ... F01L 2001/34459; F01L 2001/34479; F01L 2001/34469; F01L 1/344; F01L 2001/34453
See application file for complete search history.

(56) References Cited

U.S. PATENT DOCUMENTS

| | | | | |
|---|---|---|---|---|
| 6,439,182 | B1 | 8/2002 | Sugiura | |
| 8,851,034 | B2 | 10/2014 | Boese et al. | |
| 9,328,637 | B2 | 5/2016 | Weber et al. | |
| 2013/0233261 | A1* | 9/2013 | Watanabe ..... | F01L 1/3442 123/90.15 |

FOREIGN PATENT DOCUMENTS

| | | | |
|---|---|---|---|
| DE | 102008050622 | | 4/2010 |
| DE | 102012213176 | A1 | 1/2014 |
| EP | 1568856 | | 8/2005 |

* cited by examiner

CAMSHAFT ADJUSTER

The present invention relates to a hydraulic camshaft adjuster of the vane cell type which includes a rotor and a stator which are supported in such a way that they are rotatable relative to one another about a longitudinal axis or rotation axis of the camshaft adjuster, and a cover having multiple fastening holes, preferably through fastening holes, for accommodating fastening elements via which the cover is fixed to the front side of the stator, the cover having a locking hole into which a locking pin, which is accommodated in the rotor in such a way that the locking pin is displaceable in the axial direction, is introducible in order to lock the rotor with respect to the stator in a locking position, the position of the locking pin in the rotor being pivoted about the rotation axis by an angle $\alpha'$ in relation to a fastening element when the camshaft adjuster is used as an outlet adjuster, the position of the locking pin in the rotor being pivoted about the rotation axis by an angle $\alpha''$ in relation to a fastening element when the camshaft adjuster is used as an inlet adjuster, and the position of the locking hole in the cover being pivoted about the rotation axis by an angle $\alpha$ in relation to the position of a fastening hole.

BACKGROUND

Camshaft adjusters are used for a targeted adjustment of the phase position between a camshaft and a crankshaft in an internal combustion engine. They allow an optimized setting of valve timing via the engine load and the engine speed. In this way, fuel consumption and exhaust gas emissions may be significantly reduced and the power of the engine may be increased.

A camshaft adjuster is generally made up of a stator, a rotor positioned in the stator, and two sealing covers. A number of pressure chambers, also referred to as vane chambers, are formed in the stator, and are separated from one another by webs which extend radially inwardly away from the stator wall. Rotor vanes of the rotor which is mounted within the stator engage with the pressure chambers. For adjustment of the camshaft, the pressure chambers are acted on by hydraulic medium, as the result of which the rotor is rotated within the stator. Spring elements are often used to move a rotor back into a neutral or starting position during operation of a camshaft adjuster. This requires a secure fastening and position determination of the spring element on the rotor and the stator.

Camshaft adjusters are used for adjusting a camshaft which controls the intake valves of an internal combustion engine, and for adjusting a camshaft which controls the exhaust valves of an internal combustion engine. The former are also referred to as inlet camshaft adjusters, and the latter, as outlet camshaft adjusters. Due to their function, inlet camshaft adjusters and outlet camshaft adjusters differ in structural design, in particular with regard to the relative angular position of the locking position. In the prior art, for each type of adjuster it is necessary to provide separate covers which are suitable for the rotor and the stator, and for the particular locking position that is present. The inlet adjuster cover differs from the outlet adjuster cover in that the particular angular positions or positions of the locking slots are associated only with the type of adjuster in question (inlet adjuster or outlet adjuster), or the particular locking bolt position.

A hydraulic camshaft adjuster for an internal combustion engine, including an outer rotor and an inner rotor, is known from DE 10 2012 213 176 A1, the outer rotor and the inner rotor being rotatably adjustable and situated concentrically about a shared rotation axis, at least one hydraulic chamber being formed between the outer rotor and the inner rotor, into which at least one connected vane extends in each case from the outer rotor and from the inner rotor, as the result of which the hydraulic chamber is divided into at least one pressure chamber pair made up of two pressure chambers, the inner rotor having an opening situated concentrically in the rotation axis, a sealing section being formed on the inner surface of the opening between two axial sides of the inner rotor, the opening on both sides of the sealing section having a larger cross-sectional area than in the sealing section, the inner rotor being a sintered component, and the sealing section of the inner rotor being calibrated.

SUMMARY OF THE INVENTION

A disadvantage in the known prior art is a relatively high level of management effort due to the individual components required for each type of adjuster. This includes, for example, the effort for creation, checking, approval, management, etc., of technical drawings, or in particular high costs resulting from the manufacture of similar but different components of the adjuster, such as the cover, with the associated costs for tools, testing equipment, and storage. In addition, very high production volumes, which result in very cost-effective manufacture of the mentioned camshaft adjusters, are not readily achieved.

It is an object of the present invention to provide a camshaft adjuster which does not have the above-mentioned disadvantages, or has them only to a lesser extent. In particular, the aim is to achieve a cost reduction by a preferably high use of cost-effective identical parts for inlet camshaft adjusters and outlet camshaft adjusters. A further aim is to achieve synergy effects in the efforts to implement modular components. In addition, cost-effective manufacture and material management for manufacturing should be possible.

The present invention provides a camshaft adjuster in which angles $\alpha$, $\alpha'$, and $\alpha''$ are equal in magnitude and the pivot directions of angles $\alpha'$ and $\alpha''$ are oppositely directed. In other words, the position of the locking hole with respect to the position of a fastening hole may be pivoted about the longitudinal axis by an angle $\alpha$, and the pivot direction of angle $\alpha'$ in the case of an inlet camshaft adjuster may be opposite the pivot direction of angle $\alpha''$ in the case of an outlet camshaft adjuster.

Due to the design according to the present invention of the camshaft adjuster, it is advantageously possible to use the camshaft adjuster either as an inlet adjuster or as an outlet adjuster, with only one cover. In one case, the cover that is used is fixed to the stator with its one end-face side, and in the other case is fixed to the stator with its other, oppositely situated end-face side. In addition, the cover is situated transversely with respect to the rotation axis of the camshaft adjuster. For the particular use of the camshaft adjuster, it is no longer necessary to manufacture, keep in stock, and install separate, different covers, which results in a significant simplification of the organization of manufacturing processes and warehousing as well as reduced costs.

The camshaft adjuster according to the present invention is particularly suited for control drives, chain drives, and belt drives, in particular in the automotive field. Provided in the stator are a number of pressure chambers, for example three, four, five, or more pressure chambers, which are also referred to as vane cells and which are separated from one another by webs or stator segments which extend radial inwardly away from the stator wall. Rotor vanes of the rotor held within the stator engage with the vane cells. The stator in the installed state may be connected to a crankshaft in a rotatably fixed manner. The rotor may be connected to a camshaft in a rotatably fixed manner. The torsion angle of the rotor may be delimited by the webs in the stator. The rotor and stator may be manufactured in particular without cutting. They may be cold-formed, in particular deep-drawn, sheet metal components or sheet steel components. Such components are advantageously cost-effective and well suited for mass production. The stator may be designed in particular as a spur gearing component which includes external teeth facing outwardly in the radial direction.

The camshaft adjuster may include three, four, or five fastening elements. The fastening elements may be, for example, screws, journals, bolts, rivets, pins, or the like. The stator may in particular have holes, preferably through holes, which are oriented in parallel to the rotation axis and preferably formed in stator segments which separate adjacent vane cells from one another. The holes may have a thread into which screws or stud bolts which protrude through the cover and/or the stator are screwed. It is particularly advantageous when the fastening elements are screws which preferably engage with a thread in the fastening holes of the cover. Bolts, pins, or journals for fixing the cover to the stator may be held in a force-fit and/or form-fit manner in the through holes in the cover and/or the holes in the stator, in particular pressed into same.

The adjustment from the locking position may take place in the clockwise direction for an outlet camshaft adjuster, in which case the adjustment from the locking position takes place in the counterclockwise direction for an inlet camshaft adjuster. Alternatively, the mentioned adjustments for inlet adjusters and outlet adjusters may also take place in the converse manner. In other words, in the case of an outlet camshaft adjuster, the rotor may be adjusted with respect to the stator from an "advanced" locking position in the clockwise direction to the "retarded" locking position. In the case of an inlet camshaft adjuster, the rotor may then be adjusted with respect to the stator from the "retarded" locking position in the counterclockwise direction to the "advanced" locking position.

It is particularly advantageous when the cover has an essentially disk-like, in particular ring-shaped, design. The cover may have two flat side faces, in particular a front side and a rear side, which are oriented orthogonally with respect to the rotation axis of the camshaft adjuster. Both sides are designed for a sealing contact with the stator and/or rotor. The cover may in particular rest against the stator and/or the rotor, sealing off the vane cells directly or indirectly.

In one specific embodiment, the fastening elements and the fastening holes in the cover (optionally the fastening holes in the stator) in the joining plane between the cover and the stator may be provided and/or arranged axially symmetrically with respect to a transverse axis which orthogonally intersects the rotation axis.

According to the present invention, the cover has at least one locking hole. The locking hole in the cover is preferably designed as a through hole in the direction of the rotation axis, in particular in the case of a single locking hole. In the case of multiple locking holes, they may alternatively be designed as blind holes. A bushing, a sleeve, or a plug, also referred to as a locking bushing, may particularly advantageously be situated in the through locking hole. The connection of the locking bushing and the locking cover may be designed as a force-fit and/or form-fit connection, in particular glued, pressed, welded, screwed, etc. The bushing is preferably pressed into the locking hole and closes it in a sealing manner. The bushing may in particular have an essentially U-shaped cross section with a front wall and a circumferential wall adjoining the outer edge of the front wall. The shape, in particular the circumferential shape, of the bushing may be arbitrary, for example circular, oval, rectangular, triangular, or designed as a freely shaped contour. The bushing may be sintered, forged, shaped, or produced from solid material by machining, for example by milling, turning, drilling, etc. Such a component is easy and inexpensive to manufacture, and is easily installed in, in particular pressed into, the locking hole. The cover may also be manufactured as a one-part locking cover by sintering, shaping, forging, for example, or as a cast part, etc. Due to the design of the locking hole as a through hole, in addition the bushing may be joined from both sides/to both side faces of the cover.

In one specific embodiment, first and second position markings may be provided on the cover and on the stator. One portion of the first and second position markings may be formed on the cover, and another portion of the first and second position markings may be formed on the stator. These position markings may be provided in particular on the outer edge of the cover and on the outer edge of the stator, where they are clearly visible for an installer who is assembling the adjuster. The position markings may in particular be designed in the form of grooves or protrusions. The first position markings of the cover and the stator are aligned with one another when the cover is situated on the inlet camshaft adjuster in the correct orientation for same, while the second position markings of the cover and the stator are aligned with one another when the cover is situated on the outlet camshaft adjuster in the correct orientation for same.

In other words, according to the present invention a single locking cover part is designed as an identical part for inlet adjusters and outlet adjusters. For possible use in an inlet adjuster as well as in an outlet adjuster, it is necessary only for the locking bushing to be mountable from both sides, corresponding to the required locking pin position, so that the locking cover may be mounted, depending on the type of adjuster (inlet adjuster or outlet adjuster), for each turn, i.e., rotated by 180° with respect to the indicated vertical axis. Either the front side or the rear side of the locking cover is aligned with the stator or opposite to the stator, depending on the type of adjuster (inlet adjuster or outlet adjuster). Use of identical parts for the locking cover is made possible for the first time in that the stator segments have a symmetrical distribution. This means that for inlet adjusters and outlet adjusters, angles $\beta$ between adjacent fastening elements are equal in magnitude and have the same positional orientation. Angle $\alpha$, i.e., angle $\alpha'$ in the case of an outlet adjuster and angle $\alpha''$ in the case of an inlet adjuster, are equal in magnitude, but, depending on the required function for the locking pin position (base position advanced for the inlet adjuster, base position retarded for the outlet adjuster), do not have the same positional orientation, and instead have opposite positional orientations.

The locking bushing may be designed in such a way that the rotationally symmetrical inner contour and outer contour function independently of the rotational orientation during assembly, and may be pressed into the provided borehole. The borehole in the locking cover is designed in such a way that the locking bushing may be pressed in on both sides, regardless of the machining used (punching, pushing through, drilling, milling, etc.), regardless of the required machining direction (provided from the top or from the bottom), and regardless of the customary production features (punch indentation, grooves, burr direction, etc.).

However, except for the rotor, which, depending on the type of adjuster, may be different due to, for example, green compact drilling of oil channels, the generally expensive tools for mass production equipment are identical, and virtually all components for an inlet adjuster and an outlet adjuster may particularly advantageously be identical. This means that according to the present invention, the rotor, stator, sealing cover, and in particular the locking cover for inlet adjusters and outlet adjusters may have the same design, and therefore may be handled during development and also during manufacture with only one material number and with little complexity.

The locking hole may be provided with features, for example as an elongated hole or the like, in the cover for flexible positioning of a locking bushing or an insert part. Additional holes, for example boreholes in the cover, may be provided which have the function of a locking hole when the cover is used for an inlet adjuster (or outlet adjuster), but which have no function when the cover is used for an outlet adjuster (or inlet adjuster), and are closed with blind plugs or bushings, etc. Depending on the type of adjuster, the positioning of the rotor in the adjuster may take place in some other stator segment. Depending on the required installation location of the locking cover, the bushings which have no locking function may be utilized as a sealing surface. The number and location of the holes in the cover may vary, so that the cover may be used not only on an adjuster system (inlet or outlet), but also for other adjusters and other applications.

BRIEF DESCRIPTION OF THE DRAWINGS

The present invention is explained in greater detail below with reference to exemplary embodiments, with the aid of drawings.

DETAILED DESCRIPTION

Figure 1:
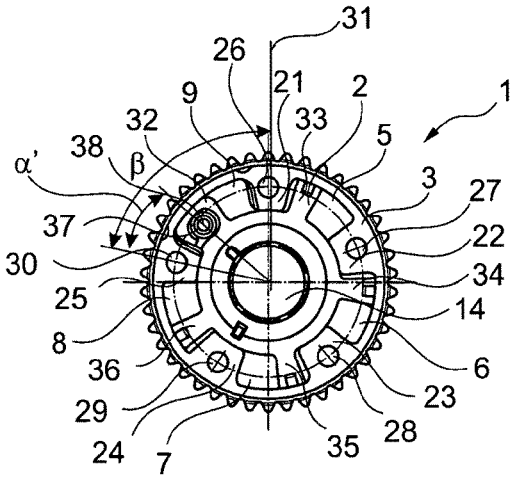
FIG. 1 shows a top view onto one specific embodiment of a camshaft adjuster according to the present invention, as an outlet adjuster without a cover.

The figures are merely schematic, and are used only for an understanding of the present invention. Identical elements are provided with the same reference numerals. Details of the various exemplary embodiments may also be combined and/or exchanged with one another.

Figure 2:
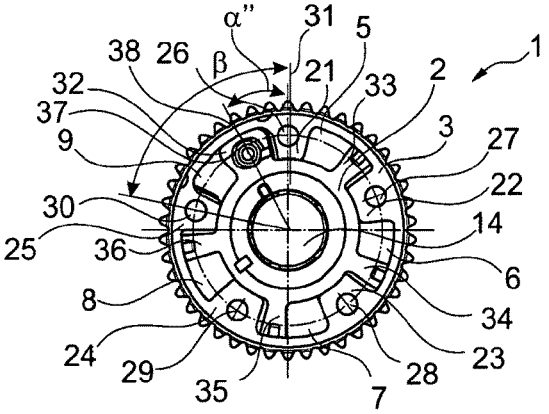
FIG. 2 shows a top view onto one specific embodiment of a camshaft adjuster according to the present invention, as an inlet adjuster without a cover.
Figure 3:
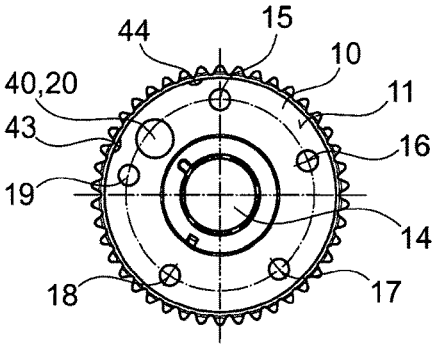
FIG. 3 shows a top view onto one specific embodiment of a camshaft adjuster according to the present invention, as an outlet adjuster with a cover.
Figure 4:
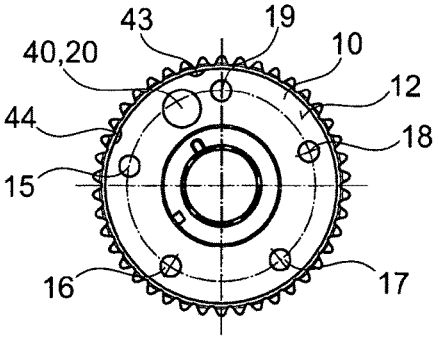
FIG. 4 shows a top view onto one specific embodiment of a camshaft adjuster according to the present invention, as an inlet adjuster with a cover.
Figure 5:
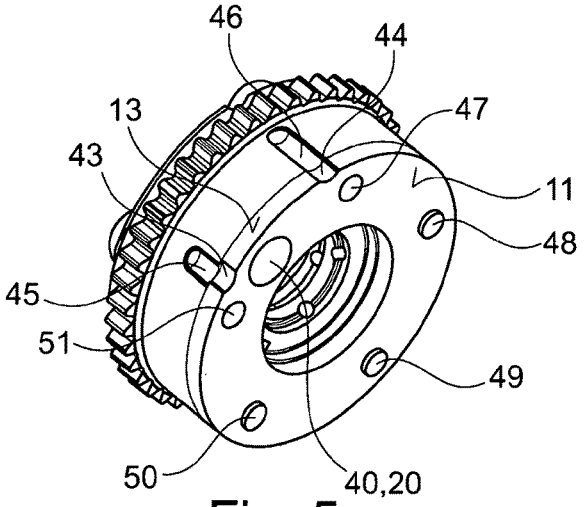
FIG. 5 shows a perspective view of the camshaft adjuster of FIG. 3.
Figure 6:
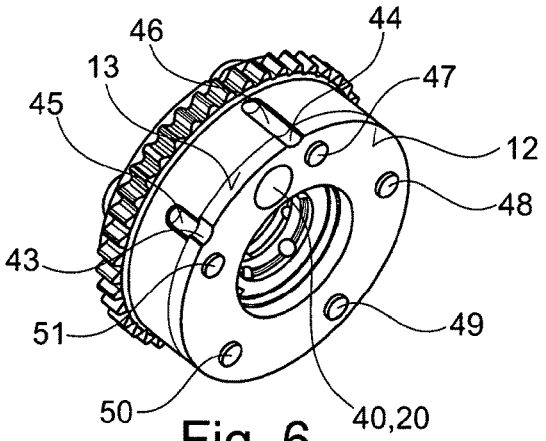
FIG. 6 shows a perspective view of the camshaft adjuster of FIG. 4.

FIGS. 1, 3, and 5 show a camshaft adjuster 1 according to the present invention as an outlet adjuster. FIGS. 2, 4, and 6 show a camshaft adjuster 1 according to the present invention as an inlet adjuster. In both specific embodiments, camshaft adjuster 1 is used for adjusting the rotation angle of a camshaft, not shown, with respect to the crankshaft of an internal combustion engine. The gas exchange valves of the internal combustion engine are actuated with the aid of the camshaft. The optimum valve timing changes with the engine speed. For the intake valves, the timing is retarded with increasing engine speed, and for the exhaust valves it is advanced. For engines having separate camshafts for the intake valves and exhaust valves, there is the option of easily achieving the desired speed-dependent adaptation of the timing by appropriately rotating the camshafts.

Camshaft adjuster 1, as an inlet adjuster and as an outlet adjuster, includes a stator 2 and a rotor 3 which are concentrically rotatable about a rotation axis 4 of camshaft adjuster 1, and rotatable relative to one another about rotation axis 4. Vane cells 5, 6, 7, 8, 9 are formed between rotor 2 and stator 3, and are to be acted on by pressure oil in order to effectuate a relative rotation of rotor 2 and stator 3.

A cover 10 is fastened on the front side of stator 3. The cover is used as a seal for vane cells 5, 6, 7, 8, 9 that are formed between rotor 2 and stator 3. Cover 10 is essentially ring-shaped, and is provided with a front surface 11, a rear surface 12, a circumferential outer surface 13, and a central recess 14. Cover 10 has five fastening holes 15, 16, 17, 18, 19, each provided with an internal thread, and a locking hole 20. Fastening holes 15, 16, 17, 18, 19 are designed as through holes, and are each spaced apart from one another by the same angle β. Locking hole 20 is likewise designed as a through hole. The central axes of fastening holes 15, 16, 17, 18, 19 and of locking hole 20 are in parallel to rotation axis 4.

In particular, FIGS. 1 through 4 show that the side of stator 3 facing cover 10, i.e., the joining plane between cover 10 and stator 3, is oriented axially symmetrically with respect to vertical axis 31, which is oriented orthogonally with respect to rotation axis 4, indicated in the figures.

As shown in FIGS. 1 and 3, a stator segment 21, 22, 23, 24, 25 is situated in each case between two adjacent vane cells 5, 6, 7, 8, 9. A fastening hole 26, 27, 28, 29, 30 is formed in each stator segment 21, 22, 23, 24, 25. Fastening holes 26, 27, 28, 29, 30 are each spaced apart from one another by the same angle β. Rotor 2 includes five rotor vanes 32, 33, 34, 35, 36 which are each spaced apart from one another by angle β. A locking pin receptacle 37 in which a locking pin 38 is accommodated so that it is displaceable in parallel to rotation axis 4 is formed in rotor vane 32 situated in vane cell 9.

FIG. 1 illustrates camshaft adjuster 1 as an outlet adjuster in its locking position with respect to stator 3. In this locking position, locking pin receptacle 37 is pivoted by an angle α' relative to fastening hole 30. FIG. 2 illustrates camshaft adjuster 1 as an inlet adjuster in its locking position with respect to stator 3. In this locking position, locking pin receptacle 37 is pivoted by an angle α" relative to fastening hole 30. A comparison of FIGS. 1 and 2 shows that angles α' and α" are equal in magnitude but have opposite directions, in particular with respect to angle β depicted in these figures.

Figure 8:
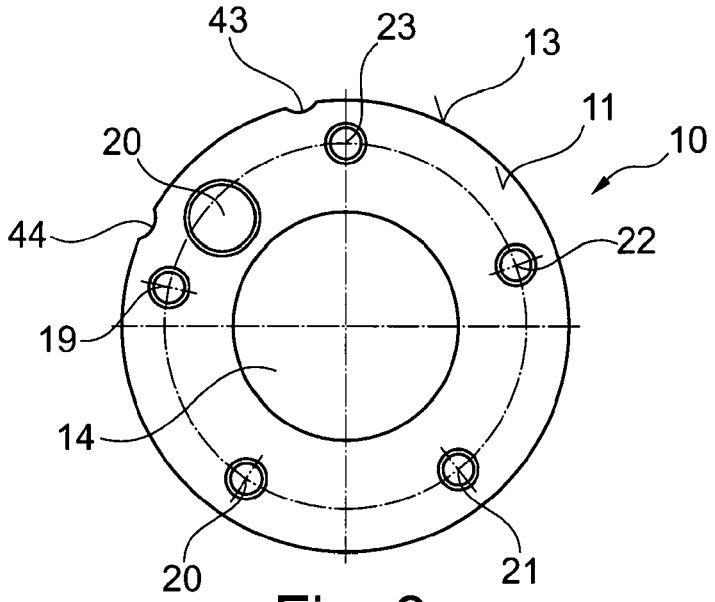
FIG. 8 shows a front view of the cover of FIG. 7.
Figure 9:
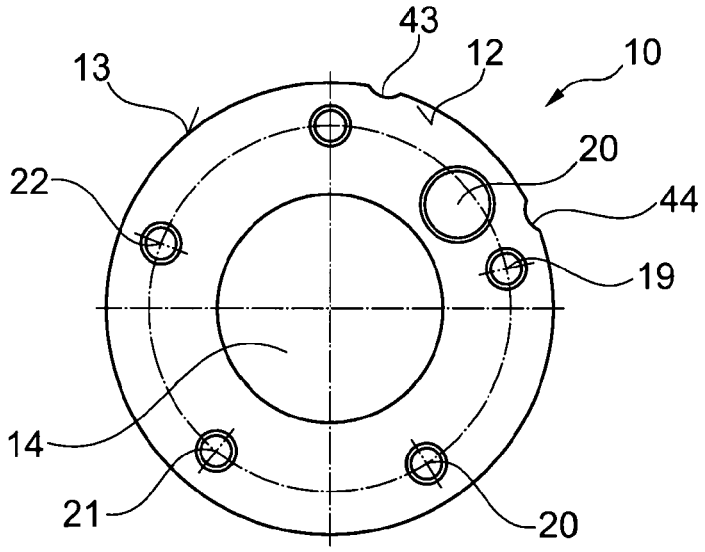
FIG. 9 shows a rear view of the cover of FIG. 7.

Locking hole 20 in cover 10 is spaced apart from fastening hole 19 by an angle α. Angle α has the same magnitude as angles α' and α". FIGS. 8 and 9 show cover 10, once in the orientation for the outlet adjuster (FIGS. 5 and 8), in which it rests with its rear surface 12 against stator 3 and rotor 2, and once in the orientation for the inlet adjuster (FIGS. 6 and 9), in which it rests with its front surface 11 against stator 3 and rotor 2. It is apparent that FIGS. 8 and 9 are axially symmetrical with respect to transverse axis 39, which is orthogonal with respect to vertical axis 31. In other words, cover 10 may be brought from the orientation for the outlet adjuster, illustrated in FIGS. 3 and 8, into the orientation for the inlet adjuster, illustrated in FIGS. 4 and 9, by pivoting it by 180° about vertical axis 31 and by 90° about rotation axis 4.

A comparison of FIG. 1 with FIG. 3, and of FIG. 2 with FIG. 4, shows that, due to such an arrangement on the inlet adjuster or outlet adjuster, locking hole 20 of cover 10 is to be brought into a position which overlaps with locking pin receptacle 37. In other words, a single cover 10 may be utilized as an inlet adjuster as well as an outlet adjuster due to the above-described geometric configuration of rotor 2, stator 3, and cover 10 by an appropriate orientation for a camshaft adjuster 1. Locking pin 38, which is displaceably accommodated in locking pin receptacle 37, may therefore engage with locking hole 20 in cover 10 when the locking pin moves out from rotor 2 in the direction of cover 10, thus preventing rotation of rotor 2 relative to cover 10, and thus relative to stator 3 on which cover 10 is fixed.

Figure 7:
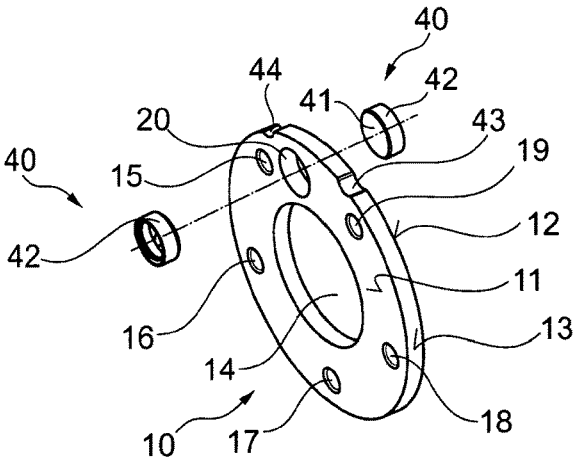
FIG. 7 shows a perspective view of a cover or locking cover for a camshaft adjuster according to the present invention.

Locking hole 20 is sealed off with the aid of a sleeve 40 which is pressed into locking hole 20. This sleeve 40 is illustrated in a perspective view in FIG. 7, and has a front wall 41, corresponding to the shape and size of locking hole 20, and a circumferential wall 42 situated at the outer circumference of the sleeve. In other words, sleeve 40 has an essentially U-shaped cross section (longitudinal section). In order for cover 10 to be usable for an inlet adjuster or an outlet adjuster by the above-described rotation about vertical axis 31, sleeve 40 must be inserted into locking hole 20, either with front wall 41 facing rear side 12 of cover 10, or with front wall 41 facing front side 11 of cover 10. This is schematically depicted in FIG. 7. Sleeve 40 may be inserted from front side 11 or from rear side 12, depending on the application.

In order to facilitate installation of cover 10 according to the poka-yoke principle, based on the particular application, and to insure correct installation of cover 10, the cover is provided with two grooves 43, 44 on its outer surface 13. Corresponding grooves 45, 46 are formed at the outer diameter of stator 3. FIGS. 5 and 6 show that when cover 10 is correctly installed as an outlet adjuster, two of the grooves (groove 43 and groove 45) are aligned with one another, and when the cover is correctly installed as an inlet adjuster, the other grooves (groove 44 and groove 46) are aligned with one another. In this way, during the installation of cover 10 it may be verified whether locking hole 20, which is closed with the aid of sleeve 40, is situated in the correct position in alignment with locking pin receptacle 37 and locking pin 38.

Figure 10:
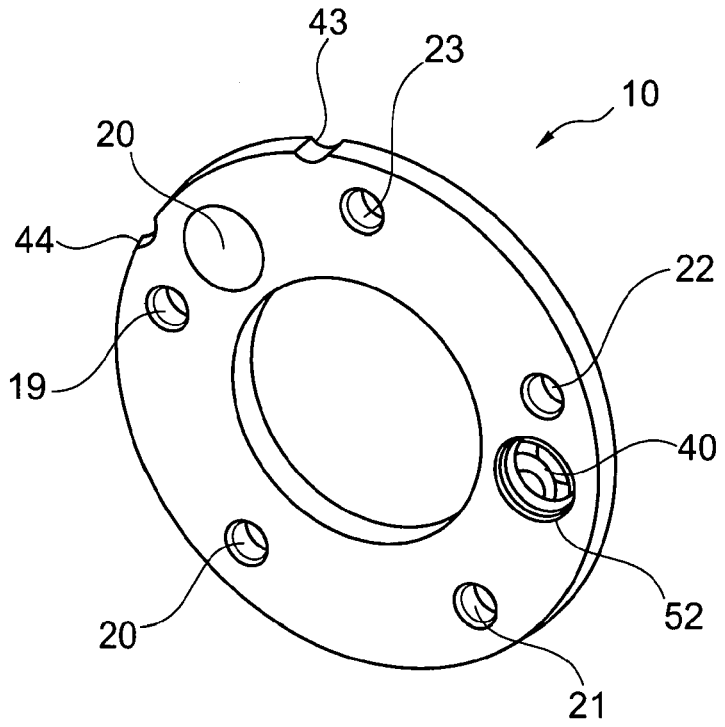
FIG. 10 shows another specific embodiment of the cover.

FIG. 10 shows another specific embodiment of cover 10 in which the cover has an additional locking hole 52. Such a cover 10 may be used on various rotor/stator combinations in which the locations of the particular locking positions are different.

LIST OF REFERENCE NUMERALS

1 camshaft adjuster
2 rotor
3 stator
4 rotation axis/longitudinal axis
5-9 vane cell
10 cover
11 front surface
12 rear surface
13 outer surface
14 central recess
15-19 fastening hole
20 locking hole
21-25 stator segment
26-30 fastening hole
31 vertical axis
32-36 rotor vane
37 locking pin receptacle
38 locking pin
39 transverse axis
40 sleeve
41 front wall
42 circumferential wall
43-46 groove
47-51 screws

What is claimed is:

1. A vane cell hydraulic camshaft adjuster comprising:

a rotor and a stator rotatable relative to one another about a rotation axis of the camshaft adjuster;

a cover having through fastening holes for accommodating fastening elements, the cover being alternatively fixable to the front side of the stator via the fastening elements in an outlet adjuster mode and in an inlet adjuster mode, the cover including a radially extending side surface facing axially toward the stator in the outlet adjuster mode and the radially extending side surface facing axially away from the stator in the inlet adjuster mode, the cover having a locking hole; and a locking pin accommodated in the rotor and displaceable in the axial direction being introducible into the locking hole in order to lock the rotor with respect to the stator, a position of the locking pin in the rotor being pivoted about the rotation axis by an angle α' in relation to one of the fastening elements when the camshaft adjuster is in the outlet adjuster mode, the position of the locking pin in the rotor being pivoted about the rotation axis by an angle a" in relation to a fastening element when the camshaft adjuster in the inlet adjuster mode, and the position of the locking hole in the cover being pivoted about the rotation axis by an angle a in relation to the position of one of the fastening holes, the rotor and the stator being coordinated with one another in such a way that the angles α, α', and α" are equal in magnitude and pivot directions of the angles α' and α" are oppositely directed.

2. The hydraulic camshaft adjuster as recited in claim 1 wherein the cover has a disk design with two flat side faces oriented orthogonally with respect to the rotation and both designed for a sealing contact with the stator or rotor, the radially extending surface forming one of the flat side faces.

3. The hydraulic camshaft adjuster as recited in claim 2 wherein the disk-design is ring-shaped.

4. The hydraulic camshaft adjuster as recited in claim 1 wherein the cover includes a further radially extending side surface opposite of the radially extending side surface, the radially extending side surface of the cover resting against the stator or the rotor, sealing off vane cells formed between the stator and the rotor in the outlet adjuster mode, the further radially extending side surface of the cover resting against the stator or the rotor, sealing off vane cells formed between the stator and the rotor in the inlet adjuster mode.

5. The hydraulic camshaft adjuster as recited in claim 1 wherein in the outlet adjuster mode, the rotor is adjustable with respect to the stator from a locking position in the clockwise direction, and in the inlet adjuster mode, the rotor is adjustable with respect to the stator from the locking position in the counterclockwise direction.

6. The hydraulic camshaft adjuster as recited in claim 1 wherein the locking hole is a through hole.

7. The hydraulic camshaft adjuster as recited in claim 1 wherein the fastening elements and the fastening holes of the stator in a joining plane between the cover and the stator are provided or arranged axially symmetrically with respect to a vertical axis orthogonally intersecting the rotation axis.

8. The hydraulic camshaft adjuster as recited in claim 1 further comprising a bushing closing the locking hole in a sealing manner and situated in the locking hole.

9. The hydraulic camshaft adjuster as recited in claim 8 wherein the bushing has a U-shaped cross section with a front wall and a circumferential wall adjoining an outer edge of the front wall.

10. The hydraulic camshaft adjuster as recited in claim 1 wherein the fastening elements are screws.

11. The hydraulic camshaft adjuster as recited in claim 10 wherein the screws engage with threads in the fastening holes.

12. The hydraulic camshaft adjuster as recited in claim 1 wherein first and second position markings are provided on the cover and on the stator.

13. The hydraulic camshaft adjuster as recited in claim 1 wherein the fastening holes are through holes.

14. The hydraulic camshaft adjuster as recited in claim 1 wherein the rotor includes a plurality of vanes, the locking pin passing through one of the vanes.

15. The hydraulic camshaft adjuster as recited in claim 1 wherein an outer circumference of the cover includes a first cover groove and a second cover groove circumferentially spaced from the first cover groove, an outer circumference of the stator including a first stator groove and a second stator groove, the first cover groove being aligned with the first stator groove in the outlet adjuster mode and the second cover groove being aligned with the second stator groove in the inlet adjuster mode.

* * * * *